United States Patent [19]

Tang et al.

[11] 4,045,800

[45] Aug. 30, 1977

[54] PHASE STEERED SUBARRAY ANTENNA

[75] Inventors: Raymond Tang; Nam San Wong, both of Fullerton, Calif.

[73] Assignee: Hughes Aircraft Company, Culver City, Calif.

[21] Appl. No.: 580,086

[22] Filed: May 22, 1975

[51] Int. Cl.[2] ..... H01Q 3/26

[52] U.S. Cl. ..... 343/854; 343/100 LE

[58] Field of Search ..... 343/777, 778, 853, 854, 343/100 LE

[56] References Cited

U.S. PATENT DOCUMENTS

| | | | |
|---|---|---|---|
| 3,176,297 | 3/1965 | Forsberg | 343/854 |
| 3,200,401 | 8/1965 | Conger et al. | 343/854 |
| 3,295,134 | 12/1966 | Lowe | 343/854 |
| 3,480,958 | 11/1969 | Tcheditch | 343/854 |
| 3,553,706 | 1/1971 | Charlton | 343/853 |
| 3,560,985 | 2/1971 | Lyon | 343/854 |
| 3,803,625 | 4/1974 | Nemit | 343/854 |
| 3,852,761 | 12/1974 | Bogner | 343/854 |
| 3,914,765 | 10/1975 | Litt et al. | 343/854 |

*Primary Examiner*—Eli Lieberman

*Attorney, Agent, or Firm*—R. H. Himes; W. H. MacAllister

[57] ABSTRACT

A phased array antenna which is adapted to provide electronic scanning over a limited scan range with a minimum number of control devices and yet maintain fairly low sidelobes is disclosed wherein the respective radiating elements are grouped into steerable subarrays. Phase steering of the subarrays is performed in discrete steps by means of phase shifters with one or two bits interspersed within the feed network. The phase state of these subarray phase shifters is selected to improve the antenna gain and suppress the grating lobes. Overlapping of the radiating elements of the subarrays is also employed to further suppress grating lobes throughout the limited scan range.

11 Claims, 12 Drawing Figures

Subarray 10 with Phase Increments at (0, 0, 0) for Beam Angle of 0°

Subarray 10 with Phase Increments at (0, 0, 1, 0) for Beam Angle of 1.5°

Subarray 10 with Phase Increments at (1, 1, 0, 1) for Beam Angle of 3.0°

Subarray 10 with Phase Increments at (1, 1, 1, 1) for Beam Angle of 4.5°

PHASE STEERED SUBARRAY ANTENNA

BACKGROUND OF THE INVENTION

Conventional phased arrays typically require one multi-bit phase shifter and one driver per radiating element. For the most phased arrays, the number of radiating elements is of the order of 200 or more; thus, the multi-bit phase shifters and drivers constitute a sizeable portion of the phased array system coat. When the phased array is required to provide only limited scan capability, it is not necessary to provide one multi-bit phase shifter for each radiating element of the antenna. Many approaches have been advanced for this purpose. Some of these approaches employ a system of reflectors and lenses which are both heavy and bulky. Other approaches employ subarrays that are either uniform or non-uniform in size. These subarrays suffer the disadvantage of high grating lobes. In addition, the non-uniform subarray requires many dissimilar units making it more costly to fabricate.

SUMMARY OF THE INVENTION

In accordance with the present invention a linear array of radiating elements is divided into subarrays which are each individually steered with a multi-bit phase shifter and driver in a manner to direct the resulting main beam pattern in the desired direction within a limited scan range. In addition to the foregoing, the respective subarray beam patterns are incrementally steered by means of one-bit and two-bit phase shifters in a common direction that suppresses the grating lobes. Corresponding one-bit and two-bit phase shifters in the respective subarrays can share a common driver unit thereby effecting a driver unit reduction of the order of 75% while still maintaining better than 20 decibels grating lobe suppression over a scan range of from 5° to 20°. Lastly, an alternate embodiment of the invention "overlaps" the radiating elements of the subarrays to decrease the width of the respective subarray beam patterns thereof thereby to provide additional grating lobe suppression. Representative embodiments of the phase steered subarray antenna of the present invention provide phase shifter bit reduction of as much as 75%.

In describing the apparatus of the present invention, digital phase shifters based on increments of phase shift which are not integral parts of 360° and other phase shifters based on increments of phase shift which are integral parts of 360° are used. In order to distinguish between these two types of phase shifters, a phase shifter based on increments of phase shift which are integral parts of 360° will be designated as "360° multi-bit phase shifters."

Figure 1:
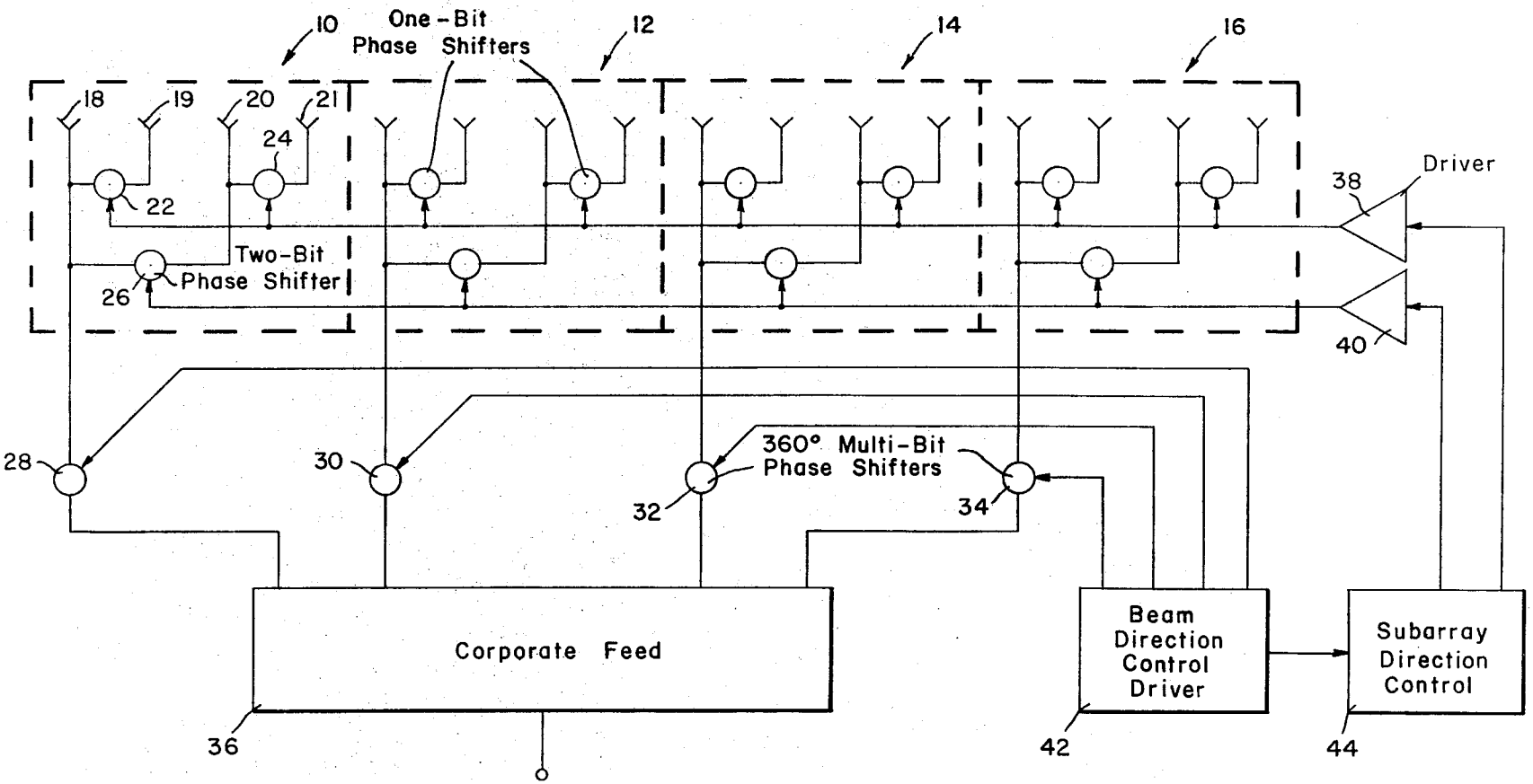
FIG. 1 illustrates a schematic circuit diagram of a phase steered subarray antenna in accordance with the invention.

Referring now to FIG. 1 of the drawings, there is shows a schematic block diagram of the phase steered subarray antenna of the present invention. More particuarly, the phase steered subarray antenna includes subarrays 10, 12, 14 and 16, which are all identical and are arranged to form a linear array. Each subarray 10, 12, 14, 16 includes radiating elements 18, 19, 20, 21 numbered from left to right, as viewed in the drawings; a one-bit phase shifter 22 interconnected between radiating elements 18, 19; one-bit phase shifter 24 interconnected between radiating elements 20, 21; and a two-bit phase shifter 26 interconnected between the junctions of radiating elements 18, 20 and phase shifters 22, 24, respectively, in a manner to provide substantially equal power to each of the radiating elements 18, 19, 20, 21. The one-bit phase shifters 22, 24 provide equal increments of phase shift. In the case of the apparatus of FIG. 1, the equal increments of phase shift for the one-bit phase shifters 22, 24 is of the order of 24° whereby phase shifts of either 0° or 24° are provided. Similarly, the two-bit phase shifter 26 has phase shift increments of the order of 24° and 48° whereby phase shifts of 0°,24°,48° and 72° are provided. The one-bit phase shifters 22, 24 of each subarray 10, 12, 14, 16 are driven by a single driver 38. Similarly the two-bit phase shifters 26 of each subarray are driven by a single driver 40. Thus, using a 1 to indicate that an increment of phase shift is switched on and a 0 to indicate that the increment is switched off, the combinations available for the phase shifters 22, 24, the smaller increment of phase shifter 26, and the larger increment of phase shifter 26, respectively, are as follows (note that because of the aforementioned connections, phase shifters 22, 24 are always the same):

| State of Phase Increments of Phase Shifters 22, 24, and low and high increments of Phase Shifter 26, respectively | Beam Angle of Subarray 10, 12, 14 and 16 |
|---|---|
| (0, 0, 0, 0) | 0° |
| (0, 0, 1, 0) | 1.5° |
| (1, 1, 0, 1) | 3.0° |
| (1, 1, 1, 1) | 4.5° |

Figure 2:
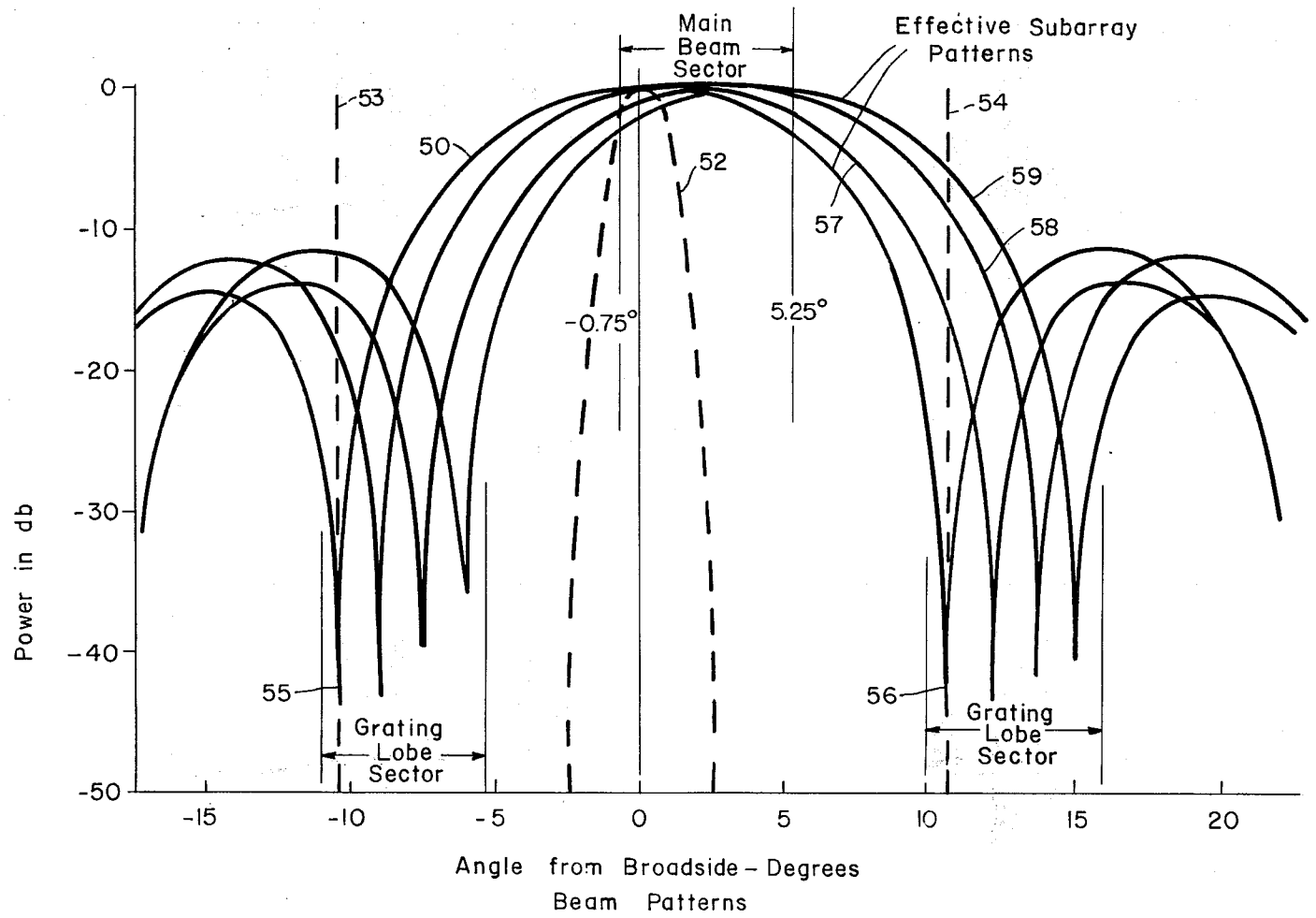
FIG. 2 shows the range of positions of the subarray patterns in the antenna of FIG. 1.
Figures 2A, 2B, 2C, 2D:
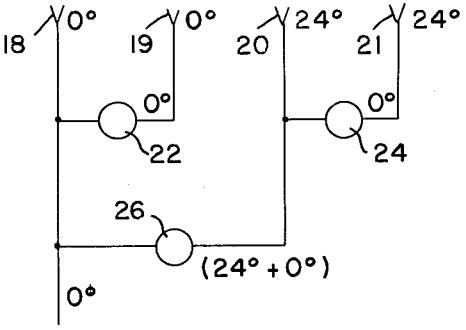
FIGS. 2A, 2B, 2C and 2D show the phase of the individual antennas of the subarrays of FIG. 1 for the position of FIG. 2.

Referring to FIG. 2A there is shown the phase at the attenna elements 18, 19, 20, 21 of subarrays 10, 12, 14 or 16 for the phase increment state (0, 0, 0, 0). Inasmuch as none of the phase shifters 22, 24, 26 introduce any phase shift when in this state, each of the antenna elements 18, 19, 20, 21 is at the same phase as the input to respective subarrays. The effective subaray pattern 50, FIG. 2, for this phase increment state is at broadside or 0°. Procceding to FIG. 2B there is shown the phase at the antenna elements 18, 19, 20, 21 of subarray 10, 12, 14 or 16 for the phase increment state (0, 0, 1, 0). In this state phase shifters 22, 24 still do not introduce any phase shift as indicated by 0° adjacent them in the figure. In phase shifter 26, however, the smaller increment is "on" and the larger increment is "off" as indicated by the phase shift (24° + 0°) adjacent phase shifter 26 in the figure. Thus, the relative phase of antenna elements 18, 19, 20, 21, is 0°, 24°, 24°, respectively. The effective subarray pattern 57, FIG. 2, for this state, i.e., (0, 0, 1, 0) is a + 1.5° from broadside.

Proceeding to FIG. 2C there is shown the phase at the antenna elements 18, 19, 20, 21 of subarray 10 for the phase increment state (1, 1, 0, 1). In this state the phase shifters 22, 24 both introduce a phase shift of 24° as indicated adjacent to them in FIG. 2C. In the case of phase shifted adjacent to them in FIG. 2C. In the case of phase shifter 26, however, the smaller increment is off and the larger increment is on as indicated by the phase shift (0° + 48°) adjacent phase shifter 26 in the figure. Thus, the relative phase of the antenna elements 18, 19, 20, 21 of subarray 10, 12, 14 or 16 is 0°, 24°, 48°, 72°, respectively. The effective subarray pattern 58, FIG. 2, for this state i.e., (1, 1, 0, 1), is + 3.0° from broadside. Lastly proceeding to FIG. 2D there is shown the phase at the antenna elements 18, 19, 20, 21 of subarray 10, 12, 14 or 16 for the phase increment state (1, 1, 1, 1). As before, the phase shifters 22, 24 both introduce a phase shift of 24° as indicated adjacent to them in FIG. 2D. In the case of phase shifter 26, however, both the smaller and larger phase increments are "on" as indicated by the phase shift (24 ° + 48°) adjacent phase shifter 26 in the figure. Thus, the relative phase of the antenna elements 18, 19, 20, 21 of subarray 10, 12, 14 or 16 under these circumstances is 0°, 24°, 72°, 96°, respectively. The effective subarray pattern 59, FIG. 2, for this state, i.e., (1, 1, 1, 1) is + 4.5° from broadside.

As is evident from the foregoing, the beam angle of subarrays 10, 12, 14, 16 is always positive. If it is desired that it be symmetrical about broadside, the beam direction can be biased to provide the desired symmetry.

The junction of radiating element 18 with phase shifter 26 of each subarray 10, 12, 14, 16 is connected through 360° multi-bit phase shifters 28, 30, 32, 34, respectively, to outputs of a corporate feed 36. The corporate feed 36 is of the type that divides power applied to the input equally among the outputs thereof as well as providing equal length electrical paths therethrough. The 360° multi-bit phase shifters 28, 30, 32, 34 are independently driven by means of separate connections to a beam direction control driver 42. In the present system, the beam direction control driver 42 scans the beam from −0.75° to 5.25°. The beam direction control driver 42 also generates a voltage corresponding to the scan angle that is applied to a subarray direction control apparatus 44 which includes conventional gating circuitry for energizing the drivers 38, 40 in a manner to activate phase shifters 22, 24, 26 as follows:

| Main Beam Span Angle | State of Phase Increments of Phase Shifters 22, 24 and 26 | Angle of Subarrays 10, 12, 14, 16 |
|---|---|---|
| −0.75° to 0.75° | (0, 0, 0, 0) | 0° |
| 0.75° to 2.25° | (0, 0, 1, 0) | 1.5° |
| 2.25° to 3.75 | (1, 1, 0, 1) | 3.0° |
| 3.75° to 5.25° | (1, 1, 1, 1) | 4.5° |

In the operation of the phase steered subarray antenna of FIG. 1, a signal to be transmitted is applied to the input of corporate feed 36 whereby it is divided equally between the subarrays 10, 12, 14 and 16. The individual subarrays 10, 12, 14 and 16, in turn, divide the power applied thereto equally between the radiating elements 18, 19, 20, 21 thereof. Referring to FIG. 2, the effective beam pattern for the subarrays 10, 12, 14, 16 at broadside is illustrated by the waveform 50. In addition, the main beam pattern is illustrated by dashed line waveform 52 and the grating lobes by dashed line waveforms 53, 54. The beam direction control driver 42 operates the 360° multi-bit phase shifters 28, 30, 32, 34 to direct the main beam 52 in desired direction within the main beam sector in a conventional manner. At broadside, the grating lobes 53, 54 of main beam 52 occur at the null 55, 56, respectively, whereby the grating lobes in the resulting beam from the entire array are substantially suppressed. This would not be the case, however, if the main beam were scanned and the subarray beams allowed to remain at broadside. That is, if the grating lobes 53, 54 are scanned away (along with main beam 52) from registration with the nulls 55, 56 they obviously would not longer be suppressed. Thus, in accordance with the invention, the subarray beam pattern 50, FIG. 2, is stepped to successive positions illustrated by waveforms 57, 58, 59 as the main beam is scanned from −0.75° to 5.25° as described above, thereby placing the nulls 55, 56 in a position to provide maximum suppression of the grating lobes 53, 54. Biasing phase shifters may be introduced to provide for placement of the main beam sector elsewhere, if desired. The placement of the subarray beam patterns to suppress grating lobes is done automatically by the energization of the drivers 38, 40 by the subarray direction control 44 in response to the main beam direction signal from beam direction control driver 42 in the manner described above. When scanning the main beam developed by subarrays 10, 12, 14, 16 by means of the 360° multi-bit phase shifters 28, 30, 32, 34, the phase shift introduced appears on each antenna element 18, 19, 20, 21, of the subarray 10, 12, 14, 16 corresponding thereto in addition to the phase shifts resulting from phase shifters 22, 24, 26 described in connection with FIGS. 2A, B, C and D. Thus, for example, if the 360° multi-bit phase shifters 28, 30, 32, 34 introduce phase shifters of 0°, 10°, 20° and 30°, respectively and is still at position (0, 0, 0, 0), i.e., the direction of the main beam 52, FIG. 2 is less than 0.75° in azimuth, the phase of each of the antenna elements of subarray 10 would be 0°, the phase of each of the antenna elements of subarray 12 would be 10°, the phase of the antenna elements of subarray 14 would be 20°, and the phase of each of the antenna elements of subarray 16 would be 30°. As the direction of the main beam 52 exceeds 0.75° but is less than 2.25°, the phase introduced by the multi-bit phase shifters 28, 30, 32, 34 adds to the phase of the antenna elements at position (0, 0, 1, 0) as shown in FIG. 2B. A smilar situation occurs for the intervals 2.25° to 3.75° and 3.75° to 5.25° corresponding to subarray positions (1, 1, 0, 1) and (1, 1, 1, 1) respectively.

Figure 4:
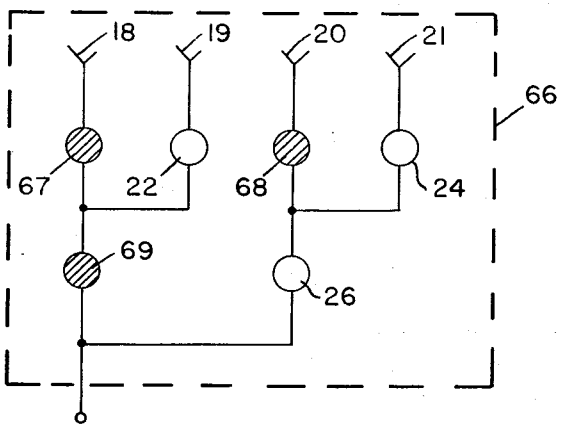
FIG. 4 illustrates a schematic circuit diagram of a four-element phased subarray.
Figure 5:
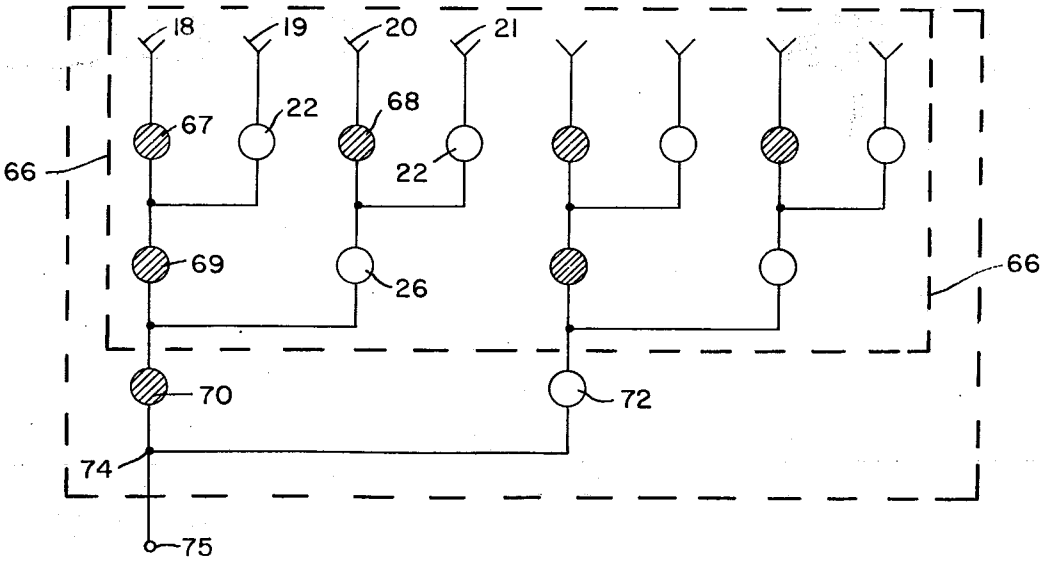
FIG. 5 illustrates a schematic circuit diagram of an eight-element phase subarray.
Figure 3:
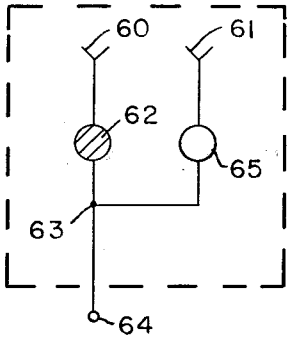
FIG. 3 illustrates a schematic circuit diagram of a two-element phased subarray.

Referring to FIGs. 3, 4, and 5 there is shown schematic circuit diagrams of two, four and eight element phased subarrays, respectively, with optional biasing phase shifters. which are shaded to indicate a fixed phase shift. More particularly, referring to FIG. 3, a two-element phased subarray in accordance with the invention includes radiating elements 60, 61. Radiating element 60 is connected through a phase shifter 62 of a selected fixed phase shift to a power dividing junction 63 which, in turn, is connected to a terminal 64. Radiating element 61 is connected through a one-bit phase shifter 65 to the power dividing junction 63. The use of the phase shifter 62 is optional in the event it is desired, for example, to bias the direction of the beam pattern so that the two positions are symmetrical about broadside.

FIG. 4, on the other hand, illustrates a four-element phased subarray 66 which is the same as subarrays 10, 12, 14 or 16 of FIG. 1 with fixed phase shifters 67, 68 connected in series with the radiating elements 18, 20, respectively, and a fixed phase shifter 69 connected in series with the subarray formed by radiating elements 18, 19. The phase shifts of phase shifters 67, 68, 69 are typically selected to provide symmetry within the main beam sector of the array. Further, an eight-element phased subarray, as shown in FIG. 5, can be provided by connecting two four-element phased subarrays 66 through a fixed phase shifter 70 and a three-bit phase shifter 72, respectively, to a power-dividing junction 74 which is connected directly to a terminal 75. The subarrays of FIGS. 3 and 5 are incorporated into linear arrays in the same manner as the subarray of FIG. 4. It has been found that the four-element phased subarray provides the maximum saving in component parts.

Figure 6:
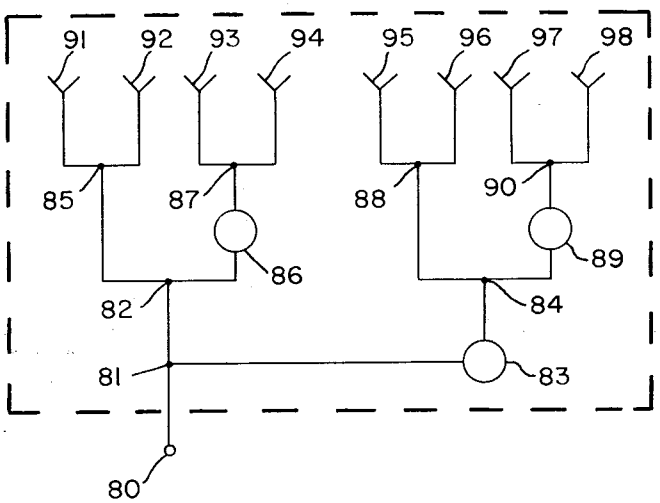
FIG. 6 illustrates a schematic circuit diagram of a four-element phased subarray with two-radiator radiating elements.

Referring to FIG. 6, there is shown a four-element phased subarray with two-radiator radiating elements. In particular, a terminal 80 of the subarray connects to a power-dividing junction 81 which, in turn, connects to a power-dividing junction 82 and through a two-bit phase shifter 83 to a power dividing junction 84. Further, junction 82 is connected to a power-dividing junction 85 and through a one-bit phase shifter 86 to a power-dividing junction 87. Similary, junction 84 is connected to a power-dividing junction 88 and through a one-bit phase shifter 89 to a power-dividing junction 90. The junction 85 is then connected to radiating element 91, 92; junction 87 is connected to radiating elements 93, 94; junction 88 is connected to radiating elements 95, 96; and junction 90 is connected to radiating elements 97, 98. All of the radiating elements 91–98 are equally spaced in the order named along the subarray of FIG. 6. The subarray of FIG. 6 is used in the same manner as the subarrays 10, 12, 14 and 16 in the antenna of FIG. 1.

Figure 7:
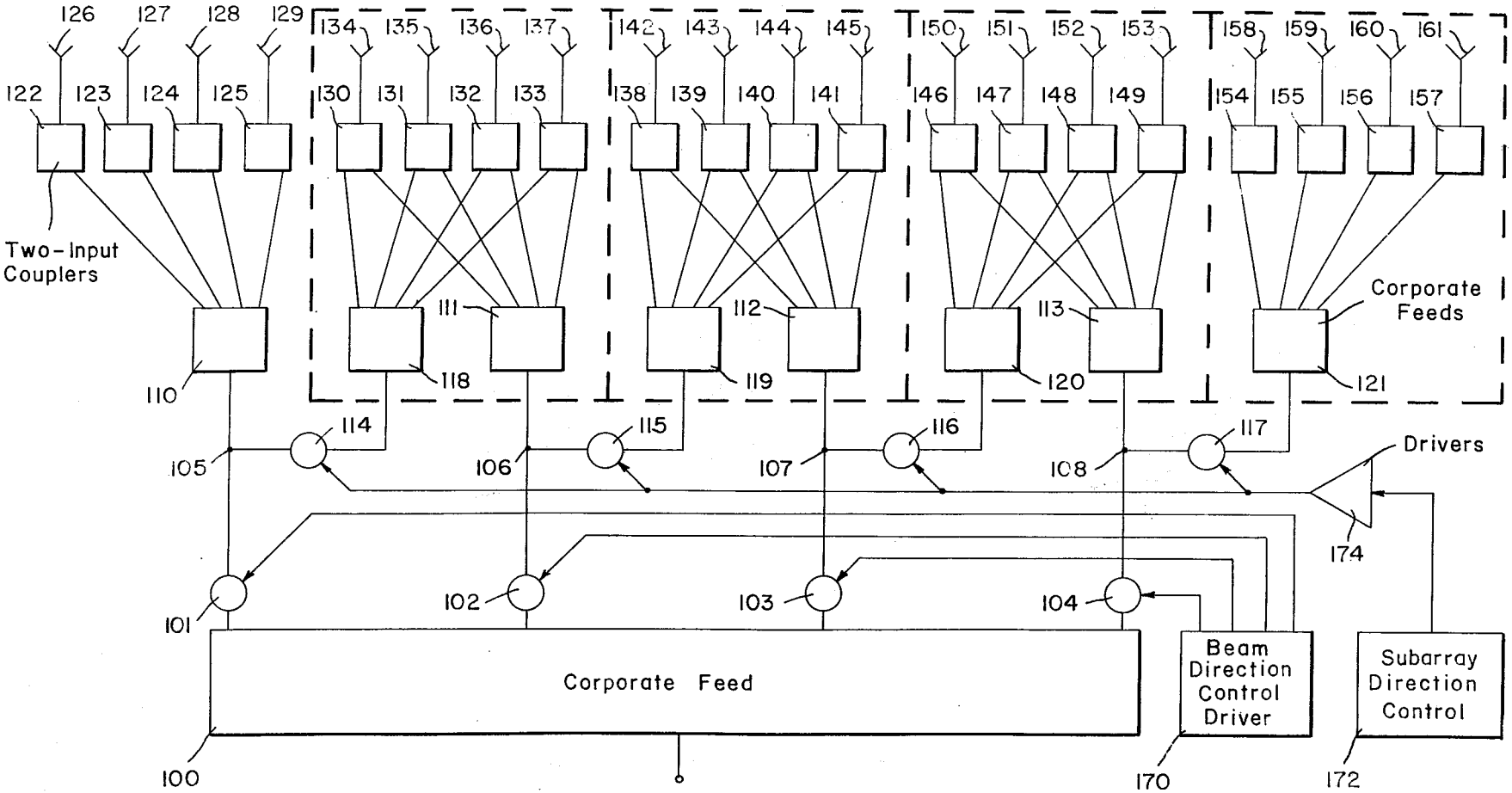
FIG. 7 illustrates a schematic circuit diagram of a segment of a phase steered subarray antenna with a four-radiator overlapping element.

Referring now to FIG. 7, there is shown a segment of a linear array composed of two-element phase steered subarrays with four radiator overlapping elements. The antenna of FIG. 7 includes a four-output corporate feed 100 which is connected through 360° multi-bit phase shifters 101, 102, 103 and 104 to power-driving junctions 105, 106, 107 and 108, respectively, Power-driving junctions 105, 106, 107 and 108, are, in turn, connected to the input of four-output corporate feeds 110, 111, 112 and 113, respectively, and, in addition, are connected through one-bit phase shifters 114, 115, 116 and 117 to the inputs of four-output corporate feeds 118, 119, 120 and 121, respectively. The outputs of corporate feed 110 are connected to one input of two-input couplers 122, 123, 124 and 125. Couplers 122, 123, 124 and 125 are, in turn, connected to radiating elements 126, 127, 128 and 129, respectively. The outputs from corporate feed 118 are connected to one input of two-input couplers 130, 131, 132 and 133, the remaining inputs of which are connected to the outputs of corporate feed 111. Couplers 130, 131, 132 and 133 are then connected to radiating elements 134, 135, 136 and 137, respectively. In a similar manner, outputs of corporate feed 119 are connected to one input of two-input couplers 138, 139, 140 and 141, the remaining inputs of which are connected to the outputs of corporate feed 112. Couplers 138, 139, 140 and 141 are connected, respectively, to radiating elements 142, 143, 144 and 145, respectively. Continuing, outputs of corporate feed 120 are connected to one input of two-input couplers 146, 147, 148 and 149, the remaining inputs of which are connected to the output of corporate feed 113. Couplers 146, 147, 148 and 149 are connected, respectively, to radiating elements 150, 151, 152 and 153. Lastly, the outputs of corporate feed 121 are connected to one input of two-input couples 154, 155, 156 and 157 which are, in turn, connected to radiating elements 158, 159, 160 and 161, respectively. Since there is no overlap at the end of the array, the two-input couplers 122–125 and 154–157 have only one connection to the respective inputs thereof.

A beam direction control driver 170 connects to each of the 360° multi-bit phase shifters 101, 102, 103 and 104 individually for steering the main beam of the antenna. The beam direction control divider 170 also provides main beam direction information over a lead 171 to a subarray direction control apparatus 172. Subarray direction control apparatus 172 operates a driver 174 which switches the one-bit phase shifter 114, 115, 116 and 117 all "in" or all "out" simultaneously in the manner described in connection with FIG. 8 of the drawings.

Figure 8:
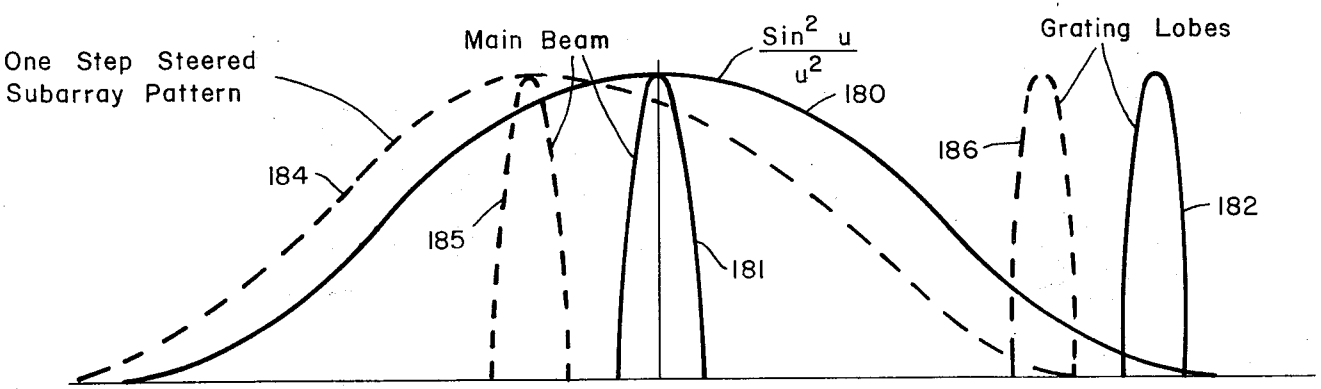
FIG. 8 illustrates the relationship of the main beam and the one-step steered subarray patterns in the antenna of FIG. 7.

In general, the operation of the antenna of FIG. 7 is the same as that for the antenna of FIG. 1 with the exception that the overlap of the radiating elements produces a subarray beam pattern 180, FIG. 8 that has a ($\sin^2\mu/\mu^2$) configuration, i.e. instead of a sharp null at the extremeties of the principal alternation, the null is very broad. Thus, the main beam 181 remains comparatively unaffected while its associated grating lobe 182 is reduced subtantially because of the low amplitude of the subarray pattern at the null. This broad null in the subarray pattern makes it possible to use only a two-element subarray whereby only one-step in the subarray pattern 180 to position 184 is required to accommodate shifts in the main beam from 181 to 185 with its associated shift in grating lobe from pattern 182 to the 186 position. Since the null amplitude of the subarray beam pattern 180, 184 at the grating lobe locations 182, 186, respectively, is low and broad, the resulting grating lobe generated (i.e. the product of the two amplitudes) is comparatively small.

What is claimed is:

1. A phasee steered subarray antenna having an input-output junction, said antenna comprising an array of radiating elements divided equally into a plurality of subarrays, each having no less than one pair of radiating elements; means coupled between said input-output junction and each of said subarrays for dividing the energy of a signal applied to said input-output junction equally among said subarrays whereby the beam pattern of said antenna array includes a narrow main beam with grating lobes on both sides thereof; means including a multi-bit phase shifter interconnected in series with each of said subarrays for determining the direction of said narrow main beam; and means responsive to said direction of said narrow main beam including no more than a one-bit phase shifter interconnected between each pair of radiating elements in each of said subarrays for concurrently and individually stepping the direction of the beam patterns of each of said subarrays to a position to make the nulls on both sides thereof approximate the position of said grating lobes thereby to minimize the resultant amplitude thereof.

2. The phase steered subarray antenna as defined in claim 1 wherein each of said radiating elements include a plurality of radiators.

3. The phase steered subarray antenna as defined in claim 2 wherein said plurality of radiators overlap.

4. A phase steered subarray antenna having an input-output junction, said antenna comprising an array or radiating elements divided equally into a plurality of subarrays each having no less than one pair of radiating elements; a corporate feed coupled between said input-output junction and each of said subarrays whereby the beam pattern of said antenna array includes a main beam with grating lobes on both sides thereof; a 360° multi-bit phase shifter interconnected between each of said subarrays and said corporate feed; means connected individually to each of said 360° multi-bit phase shifters for determining the direction of said main beam; and means responsive to said direction of said main beam including no more than a one-bit phase shifter interconnected between each pair of radiating elements in each of said subarrays for concurrently stepping the direction of the beam pattern of all said subarrays to a position that is substantially symmetrical with respect to said main beam thereby to minimize the resultant amplitude of said grating lobes.

5. A phase steered subarray antenna having an input-output junction, said antenna comprising an array of radiating elements divided into a plurality of two-element subarrays having a one-bit phase shifter coupled between the elements thereof; a corporate feed coupled between said input-output junction and each of said subarrays whereby the beam pattern of said antenna array includes a main beam with grating lobes on both sides thereof; a 360° multi-bit phase shifter interconnected between each of said subarrays and said corporate feed; means for individually driving each of said 360° multi-bit phase shifters thereby to determine the direction of said main beam; and means responsive to said direction of said main beam for concurrently driving said on-bit phase shifters thereby to step the direction of the beam patterns of said subarrays to a position that is substantially symmetrical with respect to said main beam to minimize the resultant amplitude of said grating lobes.

6. The phase steered subarray antenna as defined in claim 5 wherein each of said radiating elements includes a plurality of equally spaced radiators.

7. The phase steered subarray antenna as defined in claim 5 wherein adjacent radiating elements of adjacent subarrays constitute a common radiating element each including no less than two equally-spaced radiators.

8. A phase steered subarray antenna having an input-output junction, said antenna comprising a linear array of radiating elements grouped into a plurality of subarrays each having corresponding first, second, third and fourth radiating elements, first and second one-bit phase shifters interconnected between said first and second radiating elements and said third and fourth radiating elements, respectively, and a two-bit phase shifter interconnected between said first and third radiating elements; a corporate feed coupled between said input-output junction and said first radiating element of each of said subarrays whereby the beam pattern said antenna array includes a main beam with grating lobes on both sides thereof; a 360° multi-bit phase shifter interconnected between said first radiating element of each of said subarrays and said corporate feed; means for individually driving each of said 360° multi-bit phase shifters thereby to determine the direction of said main beam; and means responsive to said direction of said main beam for concurrently driving said first and second one-bit phase shifters in a manner to step the direction of the beam patterns of said subarrays to a position that is substantially symmetrical with respect to that of said main beam thereby to minimize the resultant amplitude of said grating lobes.

9. A phase steered subarray antenna having an input-output junction, said antenna comprising an array of radiating elements divided equally into a plurality of subarrays each including first and second adjacent radiating elements; a corporate feed coupled between said input-output junction and each of said subarrays whereby the beam pattern of said antenna array includes a main beam with grating lobes on both sides thereof; a 360° multi-bit phase shifter interconnected between each of said subarrays and said corporate feed; means connected individually to each of said 360° multi-bit phase shifters for determining the direction of said main beam; and means responsive to said direction of said main beam including a one-bit phase shifter interconnected between said first and second adjacent radiating elements of each of said subarrays for concurrently stepping the direction of the beam pattern of all said subarrays to a position that is substantially symmetrical with respect to said main beam thereby to minimize the resultant amplitude of said grating lobes.

10. A phase steered subarray antenna having an input-output junction, said antenna comprising an array of radiating elements divided equally into a plurality of subarrays each including first, second, third and fourth adjacent radiating elements; a corporate feed coupling between said input-output junction and each of said subarrays whereby the beam pattern of said antenna array includes a main beam with grating lobes on both sides thereof; a 360° multi-bit phase shifter interconnected between each of said subarrays and said corporate feed; means connected individually to each of said 360° multi-bit phase shifters for determining the direction of said main beam; and means responsive to said direction of said main beam including a one-bit phase shifter interconnected between said first and second and said third and fourth radiating elements and a two-bit phase shifter coupled between said first and third radiating elements of each of said subarrays for concurrently stepping the direction of the beam pattern of all said subarrays to a position that is substantially symmetrical with respect to said main beam thereby to minimize the resultant amplitude of said grating lobes.

11. A phase steered subarray antenna having an input-output junction, said antenna comprising an array of radiating elements divided equally into a plurality of subarrays each including first, second, third, fourth, fifth, sixth, seventh and eighth adjacent radiating elements; a corporate feed coupled between said input-output junction and each of said subarrays whereby the beam pattern of said antenna array includes a main beam with grating lobes on both sides thereof, a 360° multi-bit phase shifter interconnected between each of said subarrays and said corporate feed; means connected individually to each of said 360° multi-bit phase shifters for determining the direction of said main beam; and means responsive to said direction of said main beam including a one-bit phase shifter interconnecting between said first and second, third and fourth, said fifth and sixth, and said seventh and eighth radiating elements, a two-bit phase shifter coupled between said first and third and said fifth and seventh radiating elements, and a three-bit phase shifter coupled between said first and fifth radiating elements for concurrently stepping the direction of the beam pattern of all said subarrays to a position that is substantially symmetrical with respect to said main beam thereby to minimize the resultant amplitude if said grating lobes.

* * * * *